United States Patent [19]

Veoukas

[11] Patent Number: 4,993,212

[45] Date of Patent: Feb. 19, 1991

[54] METHOD AND APPARATUS FOR GUIDING A ZIPPERED FILM IN FORM, FILL AND SEAL PACKAGE MAKING MACHINES

[75] Inventor: Stanley Veoukas, Wheeling, Ill.

[73] Assignee: Zip-Pak Incorporated, Northbrook, Ill.

[21] Appl. No.: 473,467

[22] Filed: Feb. 1, 1990

[51] Int. Cl.[5] ..... B65B 9/08; B65B 41/12; B31C 13/00

[52] U.S. Cl. ..... 53/451; 53/551; 53/389; 493/302; 493/923

[58] Field of Search ..... 53/128, 133, 389, 410, 53/412, 450, 451, 550, 551, 552; 493/302, 923

[56] References Cited

U.S. PATENT DOCUMENTS

| | | | |
|---|---|---|---|
| 3,815,317 | 6/1974 | Toss | 53/451 |
| 4,355,494 | 10/1982 | Tilman | 53/451 X |
| 4,625,496 | 12/1986 | Ausnit | 53/451 |
| 4,646,511 | 3/1987 | Boeckmann et al. | 53/551 |
| 4,666,423 | 5/1987 | Herrington | 493/439 X |
| 4,704,842 | 11/1987 | Boeckmann et al. | 53/450 |
| 4,790,126 | 12/1988 | Boeckmann | 53/451 |
| 4,840,012 | 6/1989 | Boeckmann | 53/412 X |

*Primary Examiner*—Robert L. Spruill
*Assistant Examiner*—Beth Bianca
*Attorney, Agent, or Firm*—Hill, Van Santen, Steadman & Simpson

[57] ABSTRACT

A forming shoulder for a forming and filling tube of a form, fill and seal machine has a skirt provided with a guide channel for a longitudinal zipper area of a package making material sheet running over the forming shoulder, thereby retaining the zipper area and the sheet against lateral drifting.

14 Claims, 1 Drawing Sheet

METHOD AND APPARATUS FOR GUIDING A ZIPPERED FILM IN FORM, FILL AND SEAL PACKAGE MAKING MACHINES

BACKGROUND OF THE INVENTION

The present invention relates to the art of package making with form, fill and seal machines of the type wherein a continuous sheet of package making film is shaped by a forming shoulder tubularly about a forming and filling tube, and is more particularly concerned with avoiding lateral displacement or drifting of the film sheet relative to the forming and filling tube during the shaping process.

A problem has existed heretofore due to tendency of package making sheet material of the type having a zipper area extending longitudinally therealong intermediate side edges, tending to drift or shift laterally while being shaped tubularly about the forming and filling tube or nozzle of a form, fill and seal machine. In the course of shaping of the sheet material, the longitudinal side edges of the material, which lack any means for guiding the sheet, are brought into seaming relation. The zipper is intended for reclosable fastening of the mouth ends of packages ultimately formed from the material, while the seamed side edges of the material will form closed ends of the packages. Sides of the packages are sealed closed by the customary sealing bar and pull down mechanism of the machine. By way of information, and not limitation, a disclosure of the general type of form, fill and seal package making machine with which the present invention may be useful is disclosed in U.S. Pat. No. 4,829,745, which to any extent necessary for thorough understanding of the present disclosure is incorporated herein by reference. Therefore, the present disclosure may be directed more simply to the present invention.

SUMMARY OF THE PRESENT INVENTION

An important object of the present invention is to provide a new and improved method of and means for avoiding lateral drifting or shifting of zippered package making film sheet in a form, fill and seal machine.

A more particular object of the present invention is to provide in a form, fill and seal machine a new and improved guiding arrangement to avoid lateral shifting of zippered continuous sheet material having a zipper area intermediate its sides, and more particularly a J-fold zipper area.

Pursuant to the present invention there is provided in combination with a form, fill and seal machine forming and filling tube, forming shoulder means including a skirt surrounding the tube, and a guide channel in the skirt facing toward the tube for guiding a longitudinally extending zipper area of a package making material sheet running from the forming shoulder onto the tube, whereby to avoid lateral drifting of the sheet relative to the shoulder and tube.

There is also provided by the present invention a method of restraining a running sheet of package making material against drifting laterally relative to a forming shoulder structure and an associated forming and filling tube of a form, fill and seal machine surrounded by the shoulder structure, comprising guiding a longitudinal zipper area of the material through a channel in a skirt of the shoulder structure facing the tube.

BRIEF DESCRIPTION OF THE DRAWINGS

Other objects, features and advantages of the present invention will be readily apparent from the following description of a preferred embodiment thereof, taken in conjunction with the accompanying drawings, although variations and modifications may be effected without departing from the spirit and scope of the novel concepts of the disclosure, and in which.

DETAILED DESCRIPTION

Figure 1:
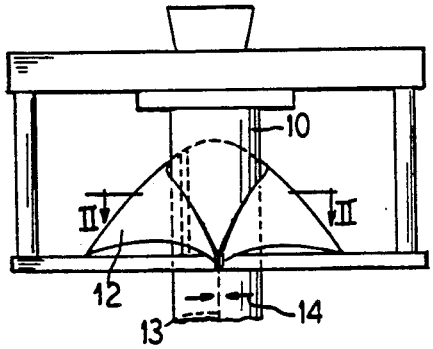
FIG. 1 is a more or less schematic front elevational view of the forming and filling tube and forming shoulder structure of a form, fill and seal bag or package making machine.

In FIG. 1 is shown a typical form, fill and seal machine forming and filing tube 10 which serves as a nozzle for directing product from a supply delivered into the upper end of the tube into bags or packages which are formed in the operation of the machine from bag or package making film material 11 supplied from a suitable source (not shown) to the machine and more particularly to a forming collar or shoulder 12. In running over the shoulder 12, the package making material is formed into essentially tubular shape about the tube 10 and is drawn progressively downwardly along the tube by the customary sealing and pull down mechanism functioning below the lower or discharged end of the tube 10.

Figure 2:
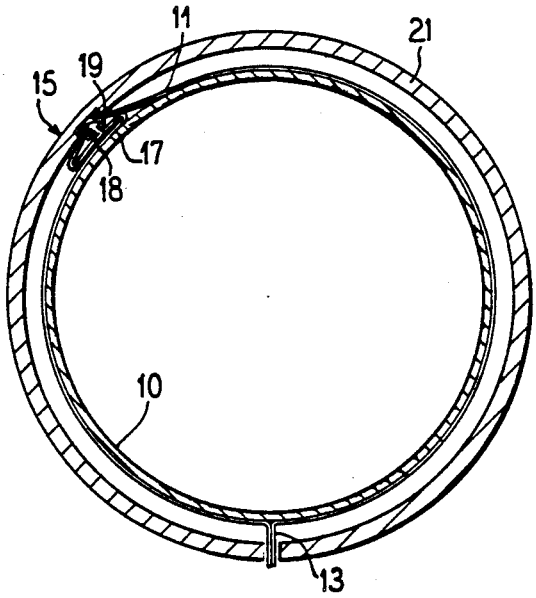
FIG. 2 is an enlarged, generally schematic sectional plan view taken substantial along the line II—II in FIG. 1.
Figure 3:
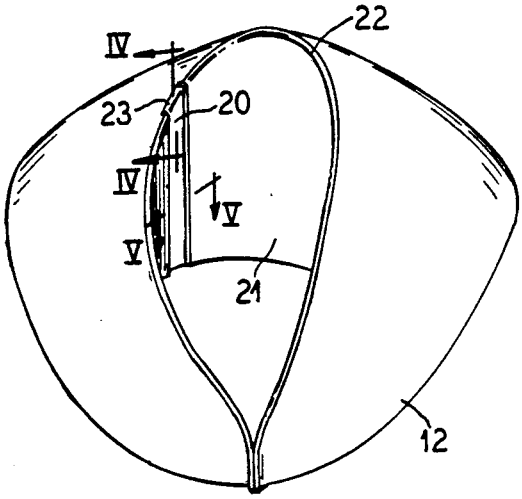
FIG. 3 is a schematic perspective plan view of the forming shoulder structure in FIG. 1.

At completion of the tubular shaping of the bag making material 11, longitudinal side edge portions are brought into fin-like lapping relation as demonstrated in FIG. 2 to form a seal closure 13 along the length of the now tubular film. It will be understood that as the tubular material 11 advances down the tube 10, the fin-like lapping seam 13 will be sealed as by means of conventional sealing bars or other suitable means represented schematically by the arrows 14 in FIG. 1.

Material 11 of the kind with which the present invention is concerned may be, and in the present disclosure is, equipped with extruded plastic zipper means 15 longitudinally therealong intermediate the longitudinal side edges of the material. Because there is no means along the side edges for guiding the material longitudinally for preventing lateral shifting or drifting of the advancing or running material, new and improved guidance means are provided herein cooperatively related to the zipper 15 area of the material 11 to accomplish this anti-drifting purpose. More particularly such means are adapted for accommodating the zipper structure where it comprises a so-called J-fold 17 in which the zipper includes a profile such as a male rib profile 18 on the fold reclosably interengaged with a confronting groove shaped female zipper profile 19.

The guidance means for the zipper 15 is desirably in the form of a groove channel 20 in a customary skirt 21 extending downwardly from a smoothly radius curved crest edge 22 at juncture of the skirt with the upper end of the shoulder 12. The channel 20 has at the crest 22 a similar lead-in radius crest 23 in a clearance depression leading into the top of the channel 20 and over which crest 23 the zipper area of the bag making material 11 moves from the upwardly slanting body of the shoulder 12 into the groove 20 in the travel of the material 11 to and then downwardly between the skirt 21 and the wall of the tube 10 and wherein the material is held in the tubular shape by the skirt 21.

Figure 5:
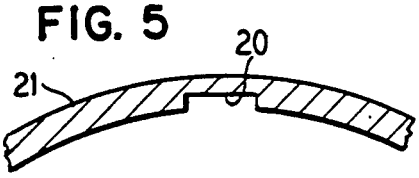
FIG. 5 is an enlarged fragmentary sectional detail view taken substantially along the line V—V in FIG. 3.

In a practical arrangement, as shown in FIG. 5, the width of the groove may be on the order of ¼" wide and about 1/16" deep, where the skirt 21 is about ⅛" thick.

Figure 4:
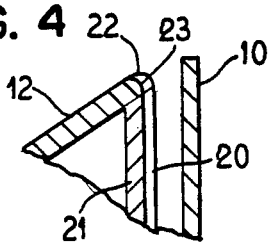
FIG. 4 is an enlarged fragmentary sectional detail view taken substantially along the line IV—IV in FIG. 3.

It will be appreciated that for illustrative purposes the annular space between the skirt 21 and the tube 10 is shown in FIGS. 2 and 4 in a much exaggerated width, but that in actuality that space will be just sufficient to permit tubular shaping of the material 11 and free running clearance for the shaped material.

As a result of the guide channel 20, the guided zipper area 15 controls the material 11 against shifting or drifting laterally as it is shaped tubularly about the tube 10. This assures that the fin seam 13 will be formed up accurately.

It will be understood that variations and modifications may be effected without departing from the spirit and scope of the novel concepts of the present invention.

What is claimed is:

1. In combination with a form, fill and seal machine forming and filling tube:

forming shoulder means including a skirt surrounding said tube: and a guide channel in said skirt facing toward said tube for guiding a longitudinally extending zipper area of a package making material sheet running from said forming shoulder onto said tube, whereby to avoid lateral drifting of the sheet relative to said shoulder and tube.

2. A combination according to claim 1, wherein said shoulder means and skirt join on a radius curvature juncture, and said channel has a radius curvature lead in crest depressed in said juncture.

3. A combination according to claim 1, wherein said channel is of a width and depth to accommodate a zipper area of J-fold structure.

4. A forming shoulder for a forming and filling tube of a form, fill and seal machine, comprising said forming shoulder having an upwardly slanting body joining at a crest edge a downwardly extending skirt for shaping a package making material sheet about the filling tube, and said skirt having means thereon arranged to face toward said tube for guiding a longitudinal zipper area of said package making material sheet as the sheet runs downwardly from said crest edge and between said skirt and said tube;

said guiding means retaining said zipper area and thereby said sheet against lateral drifting between said skirt and said tube.

5. A shoulder structure according to claim 4, wherein said guide means comprises a longitudinally extending channel on said skirt facing inwardly toward the forming tube.

6. A shoulder structure according to claim 5, wherein said channel has an upper crest lead in at said crest edge.

7. A method of restraining a running sheet of package making material against drifting laterally relative to a forming shoulder structure and an associated forming and filling tube of a form, fill and seal machine surrounded by the shoulder structure, comprising:

guiding a longitudinal zipper area of said material along means through a channel in a skirt of said shoulder structure facing said tube.

8. A method according to claim 7, comprising running said zipper area over a radius curvature lead in crest depressed in the shoulder structure at the top of said skirt.

9. A method according to claim 7, comprising running said zipper area in the form of J-fold structure through said channel of a width and depth to accommodate the same.

10. A method of retaining a sheet or package making material against lateral drifting as the material is directed upwardly along a slanting body of a forming shoulder associated with a forming and filling tube of a form, fill and seal machine, and then over a crest edge from which a skirt of said forming shoulder extends downwardly about the filling tube and shapes the sheet tubularly about the tube, comprising:

running a longitudinally extending zipper area on said sheet through guide means on said skirt and which guide means faces toward said tube.

11. A method according to claim 10, wherein said guide means comprises a longitudinally extending channel on said skirt facing toward said tube, and running said zipper area through said channel.

12. A method according to claim 10, which includes running said zipper area over a radius curvature lead in depression in said crest edge.

13. A method according to claim 10, which comprises running said zipper area in the form of a J-fold structure through said guide means and which guide means is constructed of a width and depth to accommodate the J-fold structure.

14. A method according to claim 13, wherein said guide means comprises a channel, and running said zipper area through said channel.

* * * * *